United States Patent [19]

Hoffmann et al.

[11] 4,350,206

[45] Sep. 21, 1982

[54] FIRE EXTINGUISHING FOAM CONCENTRATE AND ITS APPLICATION

[75] Inventors: Bernd Hoffmann, Frankfurt am Main; Siegfried Jüng, Karben; Hans-Joachim Semmler, Hochheim am Main, all of Fed. Rep. of Germany

[73] Assignee: Hoechst Aktiengesellschaft, Frankfurt am Main, Fed. Rep. of Germany

[21] Appl. No.: 306,880

[22] Filed: Sep. 29, 1981

[30] Foreign Application Priority Data

Oct. 1, 1980 [DE] Fed. Rep. of Germany ..... 3037155

[51] Int. Cl.[3] ..... A62B 1/12

[52] U.S. Cl. ..... 169/47; 106/18.11; 106/18.24; 252/3; 252/4; 252/6.5; 252/8.05

[58] Field of Search ..... 252/3, 4, 8.05, 6, 6.5, 252/5; 106/15.05, 18.11, 18.24; 169/47

[56] References Cited

U.S. PATENT DOCUMENTS 4,020,903 5/1977 Crosbie et al. ..... 169/47
4,049,556 9/1977 Tujimoto et al. ..... 252/3

OTHER PUBLICATIONS

Miles et al., J. Phys. Chem. 48, 1944, p. 57.
Klevens et al., J. Phys. Chem. 51, 1954, p. 1.
Bernett et al., J. Phys. Chem. 65, 1961, p. 448.
Harkins, J. , Amer. Chem. Soc., 44, 1922, p. 2665.

*Primary Examiner*—Lorenzo B. Hayes
*Attorney, Agent, or Firm*—Curtis, Morris & Safford

[57] ABSTRACT

Film-forming fire extinguishing foam concentrates are described containing water, at least one hydrocarbon surfactant and at least one fluorosurfactant compatible with the latter one, which comprise a small amount of aliphatic carboxylic acids of the formula $C_nH_{2n+1}COOH$, in which n is an integer of from 7 to 9, or the salts thereof.

5 Claims, 1 Drawing Figure

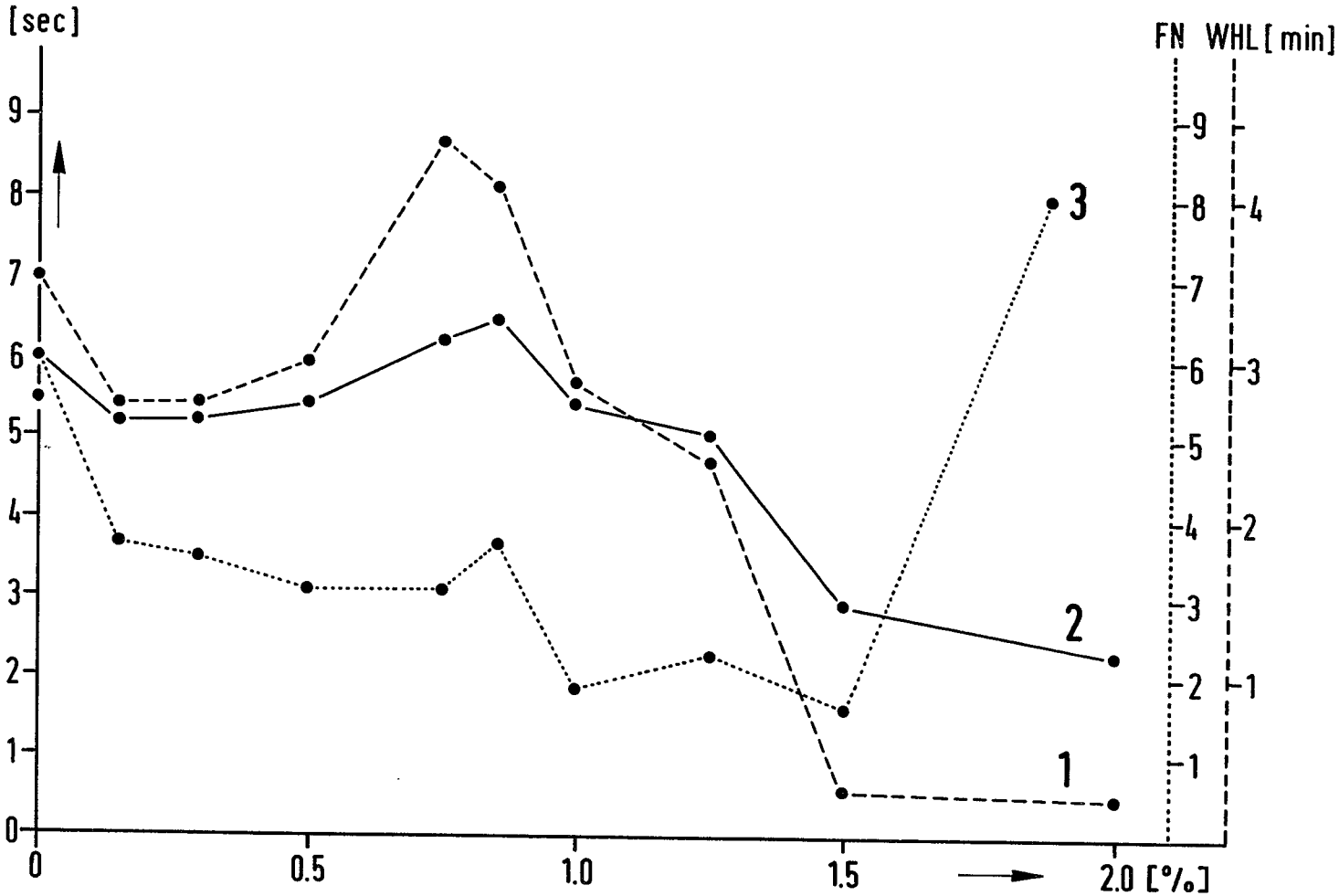
FN WHL [min]
9
8
7
6
5
4
3
2
1
[sec]
9
8
7
6
5
4
3
2
1
0
0
0.5
1.0
1.5
2.0 [%]
1
2
3

FIRE EXTINGUISHING FOAM CONCENTRATE AND ITS APPLICATION

The present invention provides a film-forming fire extinguishing foam concentrate which in addition to water contains at least one hydrocarbon surfactant and at least one fluorcontaining surfactant compatible with the hydrocarbon tenside.

Ready-to-use fire extinguishing solutions are generally prepared from concentrates of foaming agents by mixing them with the about 16- to 50-fold amount of water, and they are subsequently foamed by incorporation of air or another incombustible gas.

Modern fire extinguishing compositions on the basis of synthetic surfactants contain often interface- and surface-active fluorine compounds (fluorosurfactants) as essential components, which ensure that the foam produced by the fire extinguishing agent swims on a thin, aqueous film (density about 1 g/cm$^3$) on application against burning hydrocarbons, and that this film does not fall below the hydrocarbon despite the lower density of the latter one (about 0.7 to 0.9 g/cm$^3$). This film formation prevents furthermore evaporation of combustible liquids in an efficient manner. Since the flames thus are not nourished any longer, they can be extinguished more rapidly. Simultaneously, reinflammation by glowing pieces in the neighborhood is prevented.

Such AFFF (aqueous film-forming foam) agents are therefore applied by the fire fighters against fires due to hydrocarbons (for example gasoline), especially on airports, in the oil refining industry, or caused by military activities.

The effect of the AFFF agents resides in the fact that the fluorotensides decrease the surface tension of aqueous solutions to such an extent that they wet non-polar and water-immiscible solvents and spread thereon, although such solvents are often considerably lighter than water.

Normal wetting agents on the basis of hydrocarbons in aqueous solution can decrease the surface tension to about 0.00025 to 0.00027 N/cm (or 25–27 nM/m) only. Special mixtures of hydrocarbon tensides allow to decrease the surface tension further to 0.00022 to 0.00024 N/cm (Miles et al., J. Phys. Chem. 48, 1944, p. 57). Fluorosurfactants, however, are apt to decrease the surface tension of an aqueous solution to about 0.00015 to 0.0002 N/cm or 15 to 20 nM/m. Synergistic effects can be obtained by mixtures of fluorosurfactants and normal hydrocarbon surfactants (Klevens et al., J. Chem. Phys. 51, 1954, p. 1, and Bernett et al., Phys. Chem. 65, 1961, p. 448).

As already mentioned, aqueous solutions which contain fluorosurfactants can spread out spontaneously on the surface of liquid hydrocarbons (or other water-immiscible solvents) if the surface tension is below the critical surface tension for wetting. The criterion has been indicated by Harkins (J. Am. Chem. Soc. 44, 1922, p. 2665).

The requirements to be met by an AFFF agent are stipulated in most countries by the main consumers, that is, especially the armed forces. The principal AFFF requirements are therefore stated in U.S. Navy Military Specification MIL-F-24385 and later supplements thereof.

Examples of fluorosurfactants and hydrocarbon surfactants compatible therewith are described in German Auslegeschrift No. 1,920,625. The cited fire extinguishing agents act therefore in two directions. On the one hand, they serve as primary fire extinguishing agent in the form of foams for covering the center of the fire, and on the other, due to their film-forming properties, they prevent the development of flammable vapors and reinflammation of combustible subsbtances or, when used prophylactically, they prevent ignition altogether.

As measure for the film-forming and sealing power serves the spreading time on a determined hydrocarbon under standard conditions. The disadvantage of this method resides in the fact that, strictly speaking, it allows to obtain data for one defined hydrocarbon only. On the other hand, it is advantageous that according to this method the behavior of the fire extinguishing agent becomes manifest in a test close to the real practice. For, in case of fire, the speed at which the extinguishing foam and the film reach the outer rims of the burning surface depends directly on the measurable variable observed. Furthermore, a short spreading time implies good sealing by the water film.

Besides the spreading time of the extinguishing agent, the foam stability (measured for example as water half-life according to German Industrial Standard DIN 14272) and the foaming number are important characteristics of a fire extinguishing foam in the fire fighting practice. Both these parameters are measured on freshly prepared foam. Since several methods of foaming may be applied, it is recommended to stick to one chosen process for the entire test series.

The volume of the freshly prepared foam is measured. The foaming number results as ratio of $$\text{volume}_{foam}:\text{volume}_{starting\ solution}.$$

Freshly prepared foam is observed and the water separation is measured as function of time. The time within which half of the initially used aqueous phase has separated again is stated as water half-life.

When the composition of fire extinguishing concentrates is changed in order to improve the properties it has often been observed that the above three parameters behave antagonistically. For example, when the foaming properties are easily improved, this results in a prolonged spreading time, and vice versa. Similarly, quality and quantity of the foam can be improved by increasing the surfactant amount in the extinguishing agent; on the other hand, it was nearly impossible hitherto to shorten the spreading time.

It was therefore the object of the present invention to provide foam concentrates having a high foam stability, which can be used in the application range of heavy and medium foams.

In accordance with the invention, there have been found film-forming fire extinguishing foam concentrates containing water, at least one hydrocarbon surfactant and at least one fluorosurfactant compatible with the latter one, which comprise a small amount of aliphatic carboxylic acid of the formula $C_nH_{2n+1}COOH$, in which n is an integer of from 7 to 9, or the salts thereof. The term "salts" means soluble salts, especially salts of monovalent bases. Preferred are the sodium or ammonium salts.

The amount of carboxylic acid having the most favorable effect can be fixed for each case by simple tests. Generally, an amount of from 0.01 to 4 weight % of aliphatic carboxylic acid (relative to the sum of hydrocarbon surfactant and fluorosurfactant) is sufficient.

Suitable are branched and linear aliphatic carboxylic acids in pure form or in that of mixtures. Preferred are nonanoic acids, especially branched nonanonic acids. The aliphatic carboxylic acids can be incorporated in the form of free acids, or in that of salts of monovalent bases, for example as alkali metal or ammonium salts.

In addition to water, surfactants and carboxylic acids, the foam concentrates of the invention may contain further additives, such as antifreezes, foam stabilizers, preserving agents or anti-corrosives.

By compatibility of the surfactants, there is to be understood in this context that fluorine-containing and fluorine-free surfactants do not react with formation of an inactive product. A nonionic fluoroaliphatic surfactant can be mixed with a nonionic, ionic or cationic hydrocarbon surfactant; in the same manner, a nonionic hydrocarbon surfactant is compatible with all three kinds of fluorosurfactants. A cationic surfactant however, is often incompatible with an anionic wetting agent.

The aliphatic carboxylic acid additives are effective in all types of film-forming fire extinguishing concentrates. The fluorosurfactant as well as the hydrocarbon surfactant may be cationic, anionic, amphoteric (betainic) or nonionic. Preferably, however, they both are cationic, betainic or nonionic.

The following examples illustrate the invention.

EXAMPLE 1

The influence of small amounts of isononanoic acid added to a commercial fire extinguishing product can be taken from the following Table. FC 206 is a commercial product containing hydrocarbon surfactants and fluorosurfactants in addition to water and antifreeze agents, which is sold by the company 3 M Deutschland GmbH.

| | spreading time | foaming time | water half-life |
|---|---|---|---|
| FC 206 +0% i-nonanoic acid | 2 sec | 6 | 5.5 min |
| FC 206 +0.3% i-nonanoic acid | 1.7 sec | 5.8 | 5.1 min |
| FC 206 +0.6% i-nonanoic acid | 2.5 sec | 5.8 | 4 min |

The result is that in the optimal range of from 0 to 0.3 weight % of isononanoic acid the spreading time is favorably influenced without significantly deteriorating the other qualitiy parameters. Furthermore, it is demonstrated that in this case the addition of 0.6 weight % of isononanoic acid is too much, because the spreading time is prolonged.

EXAMPLE 2

Gradually increased amounts of isononanoic acid were added to a fire extinguishing concentrate having the following composition 0.75% fluorosurfactant $(C_7F_{15}CF{=}CH{-}CH{-}_2{-}^{(+)}N(CH_3)_2C_2H_4OH)SO_4CH_3^{(-)}$
0.75% fluorosurfactant $C_7F_{15}CF{=}CH{-}CH{-}_2{-}^{(+)}N(CH_3)_2C_2H_4OSO_3^{(-)}$
4% dimethylcoconut fatty amine oxide (30% strength, residue water)
20% butyldiglycol
74.5% drinking water The influence of an addition of 0 to 2 weight % of isononanoic acid to this fire extinguishing concentrate on the cited parameters is shown in the accompanying drawing. The optimum range for the spreading time is between 0.05 and 1.8 weight %, while the optimum values for the foaming are from 0.5 to 1%. For the water half-life, a pronounced maximum is at about 0.8 weight % (between 0.5 and 1 weight %).

The spreading time (seconds) is indicated on the left ordinate of the drawing, while the concentration (weight %) of isononanoic acid is indicated on the abscissa. Graph 1 of the figure represents the course of the water half-life (WHL) in minutes, graph 2 the spreading time in seconds and graph 3 the foaming number (FN) dependent on the concentration of isononanoic acid.

EXAMPLE 3

Gradually increased amounts of isononanoic acid were added to a fire extinguishing concentrate on the basis of alkyl sulfate having the following composition

| | |
|---|---|
| 17% | butyldiglycol |
| 6.5% | acetic acid triethanolamine |
| 4% | $ROSO_3^{(-)}HN^{(+)}(CH_2CH_2OH)_3$ (R = $C_{12}H_{25}$ + $C_{14}H_{29}$) |
| 0.75% | $C_7F_{15}CF{=}CF{=}CH{-}CH_2{-}^{(+)}N(CH_3)_2{-}C_2H_4OSO_3^{(-)}$ |
| 0.75% | $C_7F_{15}CF{=}CH{-}CH_2{-}^{(+)}N(CHhd\ 3)_2{-}C_2H_4OH$ $CH_3SO_4^-$ |
| abt. 71% | drinking water |
| 100% | |

The spreading times were measured accordingly. The result was the following:

| | |
|---|---|
| starting formulation | 9.3 sec |
| +0.3 weight % i-nonanoic acid | 5.7 sec |
| +0.5 weight % i-nonanoic acid | 4.3 sec |
| +1 weight % i-nonanoic acid | 4.7 sec |

Method for Determining the Spreading Time 100 ml of cyclohexane are charged to a Petri dish (inner diameter 139 mm, interior height 18 mm). The outlet opening of the detachable point of an Eppendorf pipette is positioned about 5 mm above the center of the liquid surface.

The fire extinguishing concentrate to be examined is diluted with 2 parts of distilled water. 0.1 ml of the solution so formed is allowed to drop freely through the point of the pipette onto the cyclohexane surface. The spreading film is observed in incident skew light. The time which passes between the appearance of the first drop of the foam solution and the extension of the film over the whole surface is measured as spreading time.

What is claimed is:

1. In a film-forming fire extinguishing foam concentrate containing water, at least one hydrocarbon surfactant and at least one fluorosurfactant compatible with the hydrocarbon surfactant; the improvement comprising 0.1 to 4% by weight based on the surfactants of an aliphatic carboxylic acid of the formula $C_nH_{2n+1}COOH$, in which n is an integer of from 7 to 9, or an alkali metal or ammonium salt thereof.

2. The concentrate as claimed in claim 1, wherein the aliphatic carboxylic acid is a nonanoic acid.

3. The concentrate as claimed in claim 1, wherein the hydrocarbon surfactant is cationic, betainic or nonionic.

4. The concentrate as claimed in claim 1, wherein the fluorosurfactant is cationic, betainic or nonionic.

5. Process for extinguishing fires of burning liquid hydrocarbons by covering the surface ablaze with a foam consisting of an incombustible gas phase and an aqueous phase containing a hydrocarbon surfactant, a fluorosurfactant and from 0.01 to 4 percent by weight based on the surfactants of an aliphatic carboxylic acid of the formula $C_nH_{2n+1}COOH$, in which n is an integer of from 7 to 9, or an alkali metal or ammonium salt thereof.

* * * * *